US010472892B1

(12) United States Patent
Conn, III et al.

(10) Patent No.: US 10,472,892 B1
(45) Date of Patent: Nov. 12, 2019

(54) METHOD AND SYSTEM FOR POSITIONING A DRILLING OR OTHER LARGE STRUCTURE USING ATTACHED POSITIONING SHOES WITH INDIVIDUALLY ADDRESSABLE WIRELESS VERTICAL AND ROTATIONAL CONTROL

(71) Applicant: Controlled Fluids, Inc., Beaumont, TX (US)

(72) Inventors: Edwin Dixon Conn, III, Beaumont, TX (US); Justin Michael Jackson, Beaumont, TX (US); Micheal Neil Scott, Kingwood, TX (US); Brandy Marie Wallace, Houston, TX (US); Jason Paul Allen, Lumberton, TX (US)

( * ) Notice: Subject to any disclaimer, the term of this patent is extended or adjusted under 35 U.S.C. 154(b) by 0 days.

(21) Appl. No.: 16/154,311

(22) Filed: Oct. 8, 2018

(51) Int. Cl.
*E21B 7/02* (2006.01)

(52) U.S. Cl.
CPC ..... *E21B 7/024* (2013.01); *E21B 7/022* (2013.01)

(58) Field of Classification Search
CPC ..... E21B 7/024; E21B 17/022
USPC ..... 173/184–185, 187
See application file for complete search history.

(56) References Cited

U.S. PATENT DOCUMENTS

| | | | | |
|---|---|---|---|---|
| 3,576,218 A * | 4/1971 | Lisenby | E02D 7/26 | 173/192 |
| 6,871,712 B2 * | 3/2005 | Koch | E21B 7/046 | 175/103 |
| 9,091,126 B2 * | 7/2015 | Thiessen | E21B 15/00 | |
| 2016/0097238 A1 * | 4/2016 | Marek | E21B 7/024 | 248/188.3 |

* cited by examiner

*Primary Examiner* — Michelle Lopez
(74) *Attorney, Agent, or Firm* — Hulsey PC

(57) ABSTRACT

A drilling rig mobility system moves a drilling rig or similar structure in an oilfield or similar environment and includes independently controllable positioning shoes attaching to the drilling rig and controllable through separate and coordinated position control commands. Each positioning shoe may be individually addressed to reposition the drilling rig. Each positioning shoe includes a hydraulic actuator and wireless control circuitry. The hydraulic actuator provides vertical, horizontal and rotational force in response to wireless control signals for wireless position and control data and instructions with a remote wireless communications device. A cylinder stomper vertically elevates the hydraulic actuator and receives and transfers the vertical and rotational force. A foot assembly transfers the horizontal force from the hydraulic actuator. A positioning shoe cylinder stomper and positioning shoe traverse cylinder provide infinitely variable position control.

20 Claims, 12 Drawing Sheets

METHOD AND SYSTEM FOR POSITIONING A DRILLING OR OTHER LARGE STRUCTURE USING ATTACHED POSITIONING SHOES WITH INDIVIDUALLY ADDRESSABLE WIRELESS VERTICAL AND ROTATIONAL CONTROL

FIELD OF THE INVENTION

The present disclosure relates generally robotic and automated methods and systems for positioning a drilling or other large structure. The disclosed method and system use attached positioning shoes, each providing individually addressable vertical and rotational control through wireless communication and feedback for infinitely variable vertical position adjustment and rotational position control.

BACKGROUND

The subject matter of the present disclosure addresses moving a drill rig in the field without the assembly and disassembly of structural components. The result is to provide drilling rig position and location control that is reliable, fast and easily performed. Because of the disclosure here provided a drilling company seeking to drill for natural resources can save thousands of dollars in the construction and deconstruction of drilling rigs, as they seek the most effective position in the field on which to newly drill for subterranean energy resources.

In the past, known methods used structural shoes but without the capability of the presently disclosed subject matter. Known systems do not provide individually addressable shoes for the positioning or operation of the positioning shoe and, therefore, do not permit individual manipulation of the shoes for various positioning demands that may face a drilling rig operator.

Because known systems lack independent control of the positioning shoe, the maintenance and repair of a malfunctioning positioning shoe has proven both complicated and expensive. In such configurations, hydraulic lines must be in place throughout the framework of the drilling rig to power the positioning shoes using the hydraulic energy source.

Another aspect of earlier positioning shoes is that there is no feedback operation or circuitry or indicator that informs the operator of how the positioning shoe is behaving.

Also, known rig positioning shoes fail to provide an effective slewing mechanism that permits variable rotational control and variation.

SUMMARY OF THE DISCLOSURE

Considering the above problems in the energy exploration and production industry, the present disclosure provides numerous innovations, improvements, and inventions relating to robotic and automated systems for repositioning an oil or energy resource drilling structure in the field. The disclosed subject matter includes methods and systems for positioning a drilling or other large structure using attached positioning shoes with individually addressable wireless vertical and rotational control.

According to one aspect of the present disclosure, here is provided a drilling rig mobility system for moving a drilling rig or similar structure in an oilfield or similar environment. The present system includes a plurality of independently controllable positioning shoes for attaching to the drilling rig and controlling through separate and coordinated position control commands. Each of the plurality of independently controllable positioning shoes can reposition the drilling rig. Each of the independently controllable positioning shoes includes a housing attached to the drilling rig and providing a structural enclosure for containing a hydraulic actuator and wireless control circuitry. The hydraulic actuator provides vertical, horizontal and rotational force in response to wireless control signals from the wireless control circuitry. The wireless control circuitry communicates wireless position and control data and instructions with a remote wireless communications device and converts the wireless position and control data and instructions to hydraulic actuator control signals. A positioning shoe cylinder stomper vertically elevates the hydraulic actuator and receives and transfers the vertical and rotational force from the hydraulic actuator. A positioning shoe foot assembly rigidly connects to the positioning shoe cylinder stomper and receives and transfers the horizontal force from the hydraulic actuator. A positioning shoe traverse cylinder slidably connects with the positioning shoe foot assembly and includes a hydraulic piston and rail assembly for receiving and horizontally moving in response to the horizontal movement force. The positioning shoe traverse cylinder contacts the oilfield ground and moves the drilling rig upon movement. The positioning shoe cylinder stomper, the positioning shoe traverse cylinder, and the positioning shoe traverse cylinder provide infinitely variable position control of the independently controllable positioning shoe.

The disclosure of the present embodiment includes the use of a positioning shoe or support for a drilling rig, as one of four shoes upon watch a drilling rig will be supported. The positioning shoe provides true wireless control from a wireless controller for complete 360° horizontal range of movement, as well as vertical elevation for raising and lowering the drilling rig. The disclosure of the present invention provides a fully-enclosed positioning shoe system that is individually addressable and that can operate in coordination with other shoes positioned on the drilling rig.

According to the present disclosure, here is provided a method for transporting heavy equipment by wireless, remote control. The functions here provided include using fluid power supplied to actuators to lift, traverse and rotate with four or more independent lift/traverse/rotate assemblies. Another feature includes using wireless control to determine direction of each lift/traverse/rotate assembly independently. The present disclosure uses a fluid power source located on each of four or more lift/traverse assemblies with electric power supplied to each assembly. Another aspect of the present disclosure includes using a fluid control system that directs fluid to each lift/traverse/rotate actuator based on a programming function.

Additional aspects of the present disclosure include using electronic feedback from each of several sensors associated with the positioning shoe and the drilling rig to maintain actuator position for each function of lift, traverse and rotate. A further aspect of the present disclosure includes using a fluid drive motor to actuate a rotation device for determining direction of travel for each lift/traverse/rotate assembly. Using a wireless, remote control the present system provides for signal movement changes to each lift/traverse/rotate assembly independently or in unison. A yet further set of features here presented include using an electrical controller on each lift/traverse assembly to provide programmed logic for each movement to include lift, traverse, rotate for directional changes, as needed.

In essence, therefore, the presently disclosed method and system provide a novel design that may be sized for and retrofitted to any existing rig or other equipment. The method and system provide the fastest known system available with rig moves at up to 60' per hour. Here, the only power required is incoming 480 VAC; no external piping or hydraulic system is needed. The method and system provide a fully self-contained onboard hydraulic system designed for efficiency, and built for reliability. Here, wireless communications between walking pods and remote control seamlessly coordinate all walking, steering, and rig rotation movements. Moreover, rig movements can be expanded to 8, 12, or more walking pods in order to synchronize ancillary equipment movement along with the rig.

Further considerations of the present disclosure include the provision enhanced rig moves with automated Rig Walking. Since, moving a land rig into position can be a time consuming and hazardous process for both equipment and people. The presently disclosed rig walking system enhances rig safety by removing workers from the drill site and minimizing the amount of equipment that needs to be disassembled for movement. This allows skilled production employees to focus more on production and less on disassembling and reassembling the drilling rig.

Another benefit of the presently disclosed system includes the features of divided work and multiplied efficiency. The novel, presently disclosed rig walking system eliminates the maze of pipes and hoses associated with a large central HPU by putting highly efficient, compact HPUs directly at the point of work. Each HPU features a designated onboard controller that communicates wirelessly with a central HMI and remote, allowing each HPU to automatically provide the correct output for safe rig movement. Once these HPUs are connected with three phase power, they are able to automate and monitor the walking process via a wireless remote.

A further benefit of the present method and system include enhanced efficiency with precise positioning. The presently disclosed system's HPU arrangement provides enhanced control of rig feet versus traditional rig walking systems, enabling a 360° range of motion at a less than 1° margin during rig moves. This allows the rig to turn about a specific target or move along an arc to approach the next drill site from the optimal direction.

Yet a further aspect of the presently disclosed method and system is the benefit of faster rig moves through synchronized expansion. The present method and system provide a decentralized HPU control, which allows for expanding from the typical four walking pods to an array of eight or more fully synchronized pods. This revolutionary design allows for ancillary equipment such as mud shakers to move in concert with the rig itself, thus yield faster moves and higher productivity.

Still a further technical advantage of the presently disclosed subject matter includes a modular and interchangeable positioning shoe the eliminate the need for a centralized or dedicated HPU, as well as all for "ground-hopping" of a single positioning shoe while detached from the rig for testing, servicing, and quality control.

These and numerous other technical and operational advantages will be clear upon an understanding of the presently disclosed subject matter, which fully support the claims made herein.

BRIEF DESCRIPTION OF THE DRAWINGS

The novel features believed characteristic of the disclosed subject matter will be set forth in any claims that are filed later. The disclosed subject matter itself, however, as well as the preferred mode of use, further objectives, and advantages thereof, will best be understood by reference to the following detailed description of an illustrative embodiment when read in conjunction with the accompany drawings, wherein:

Figure 1:
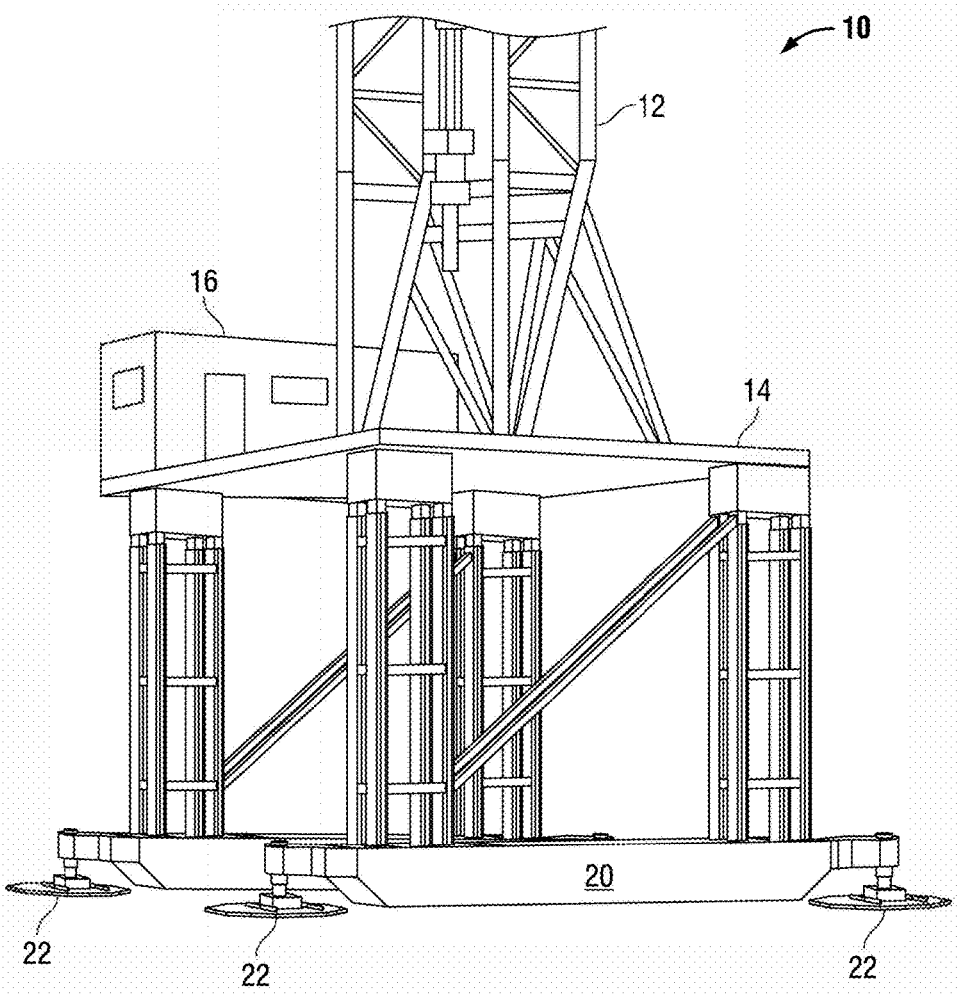
Figure 2:
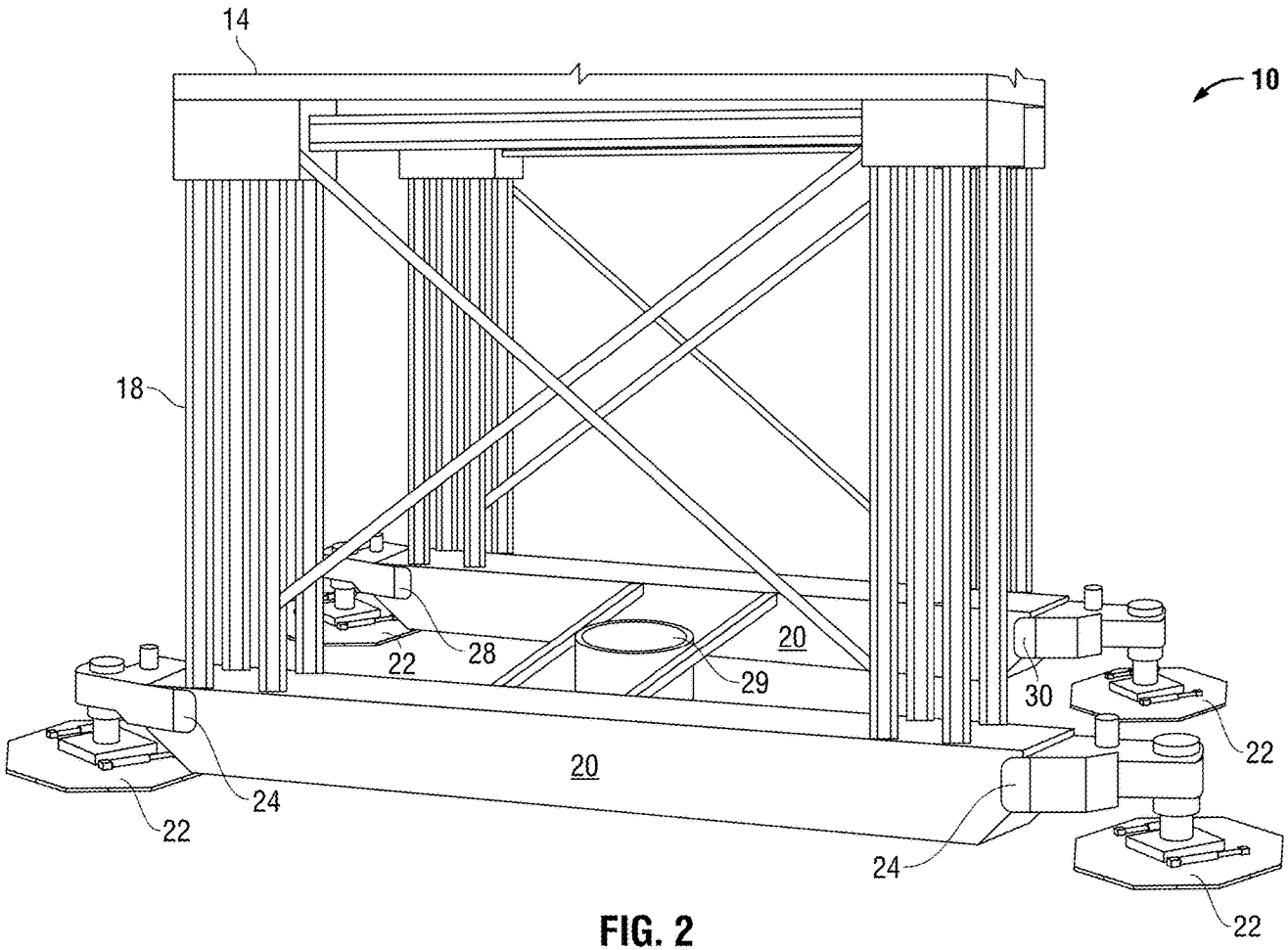
Figure 3:
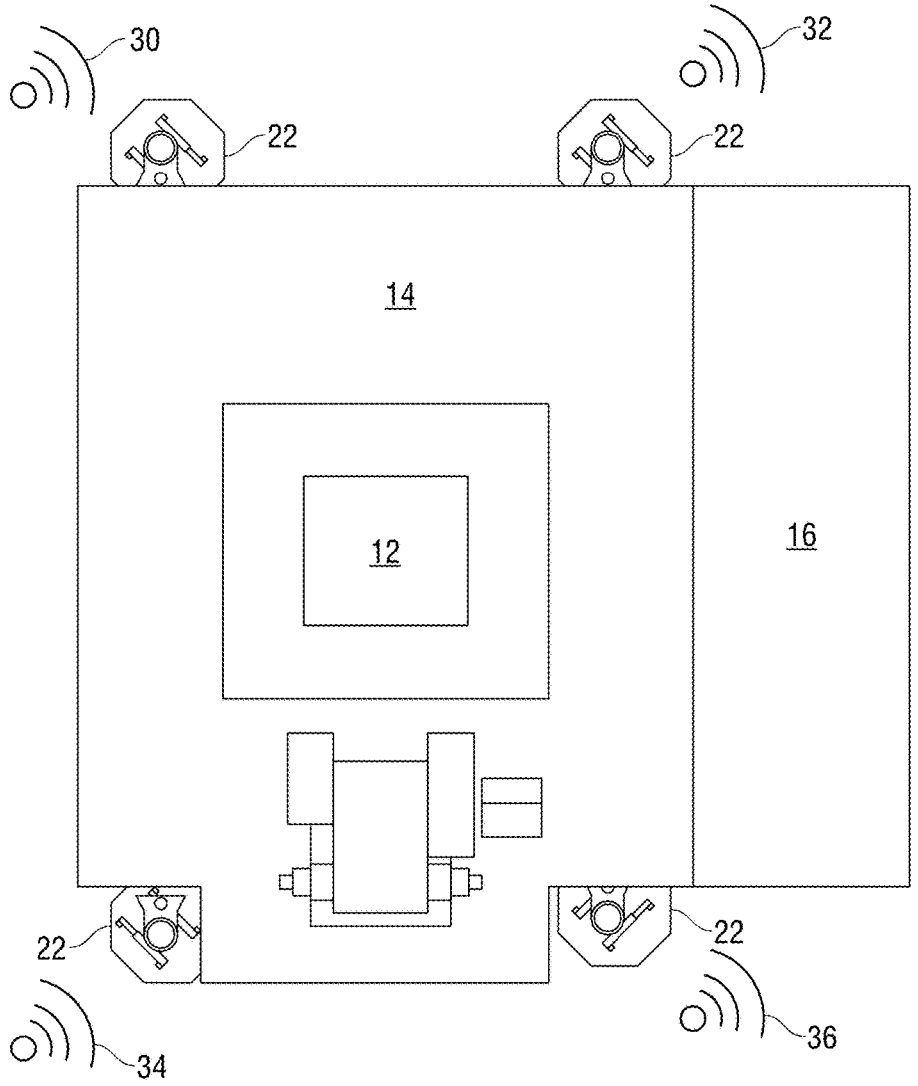
Figure 4:
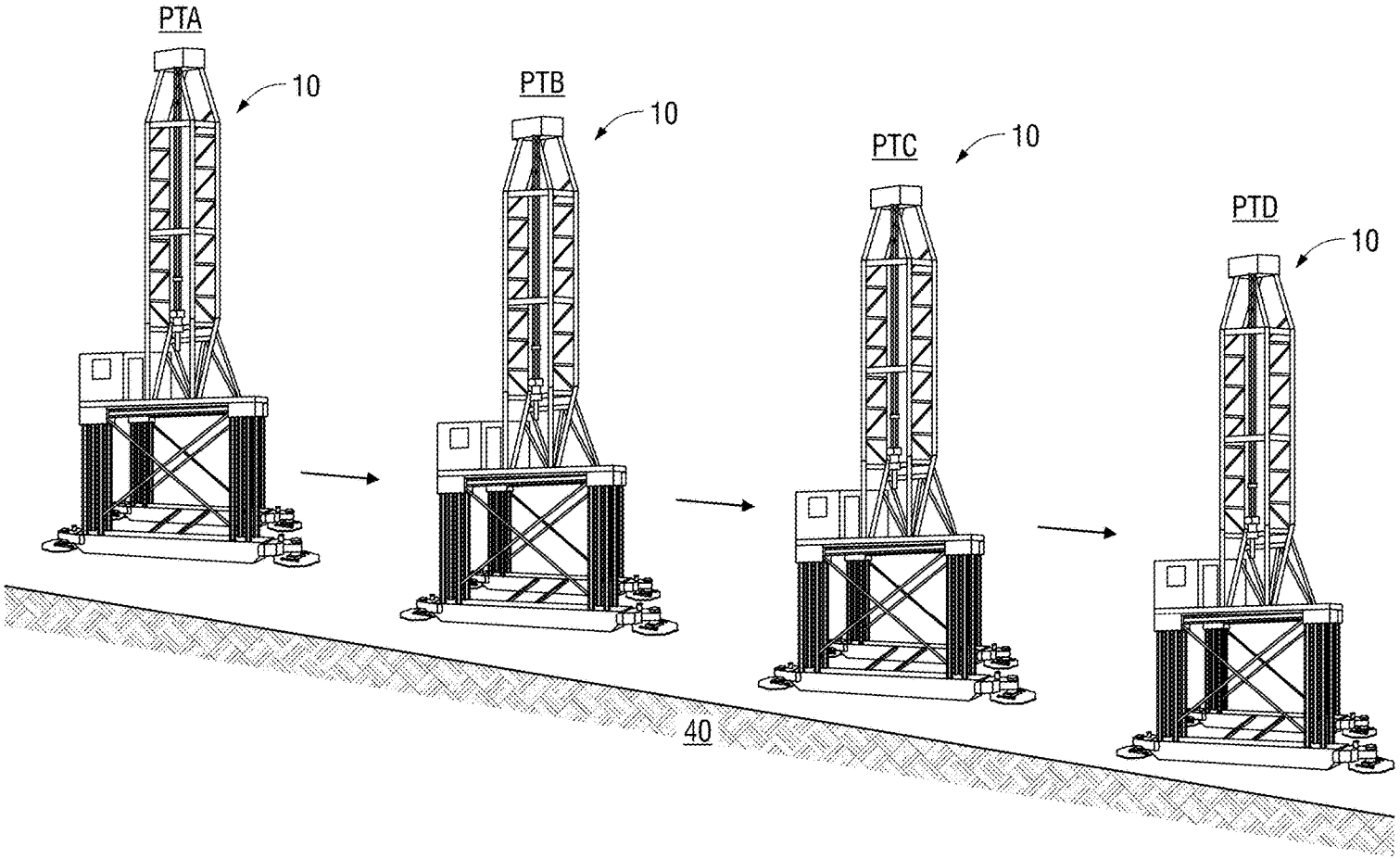
Figure 6:
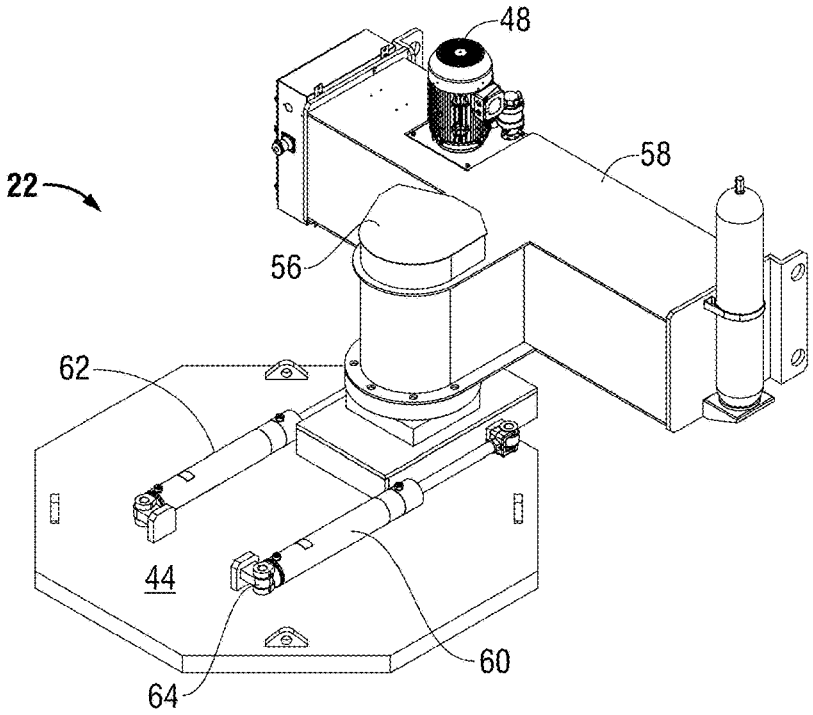
Figure 7:
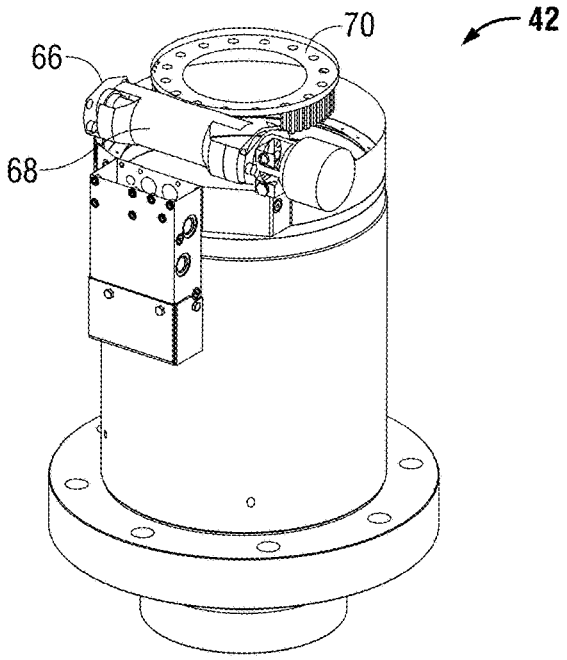
Figure 9:
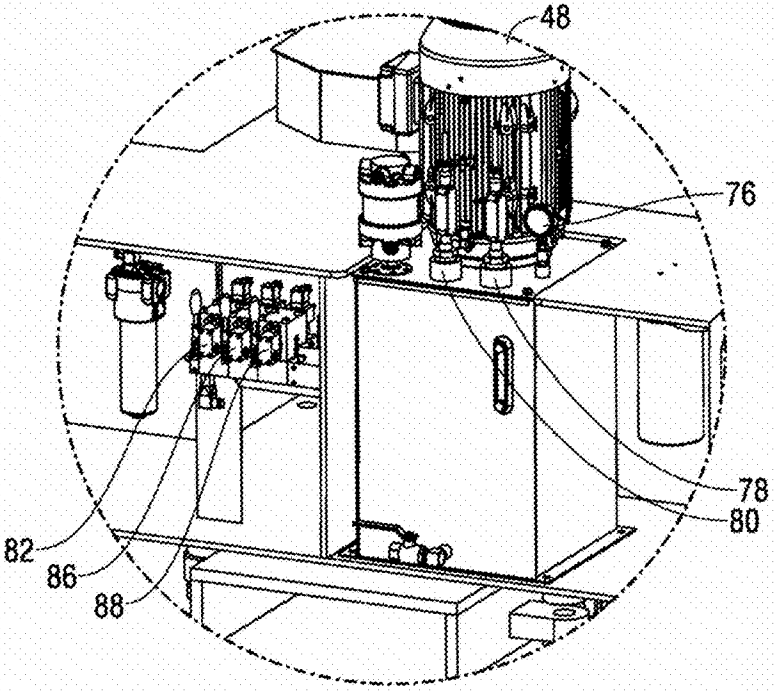
Figure 8:
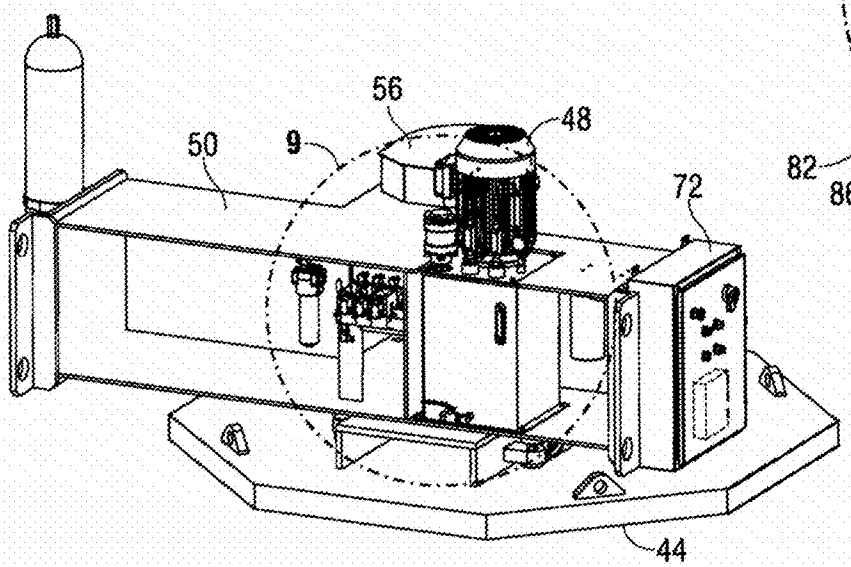
Figure 10:
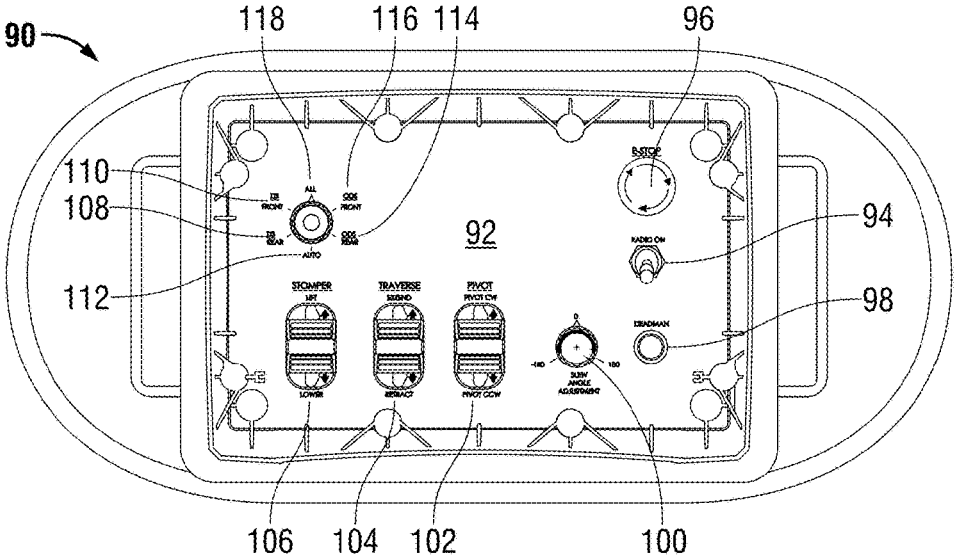
Figure 11:
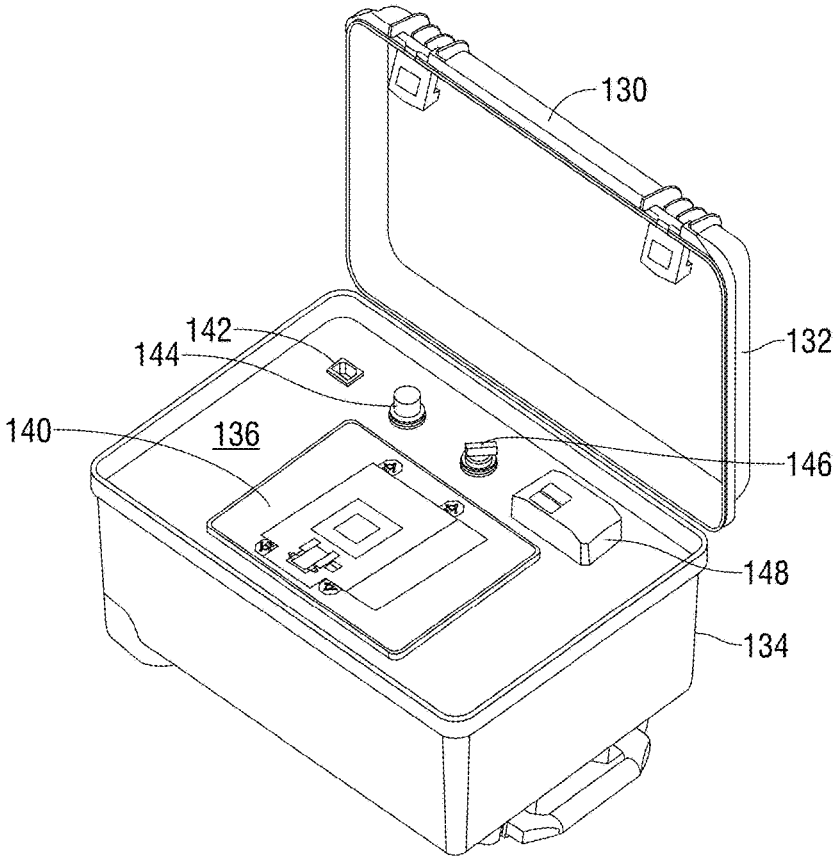
Figure 12:
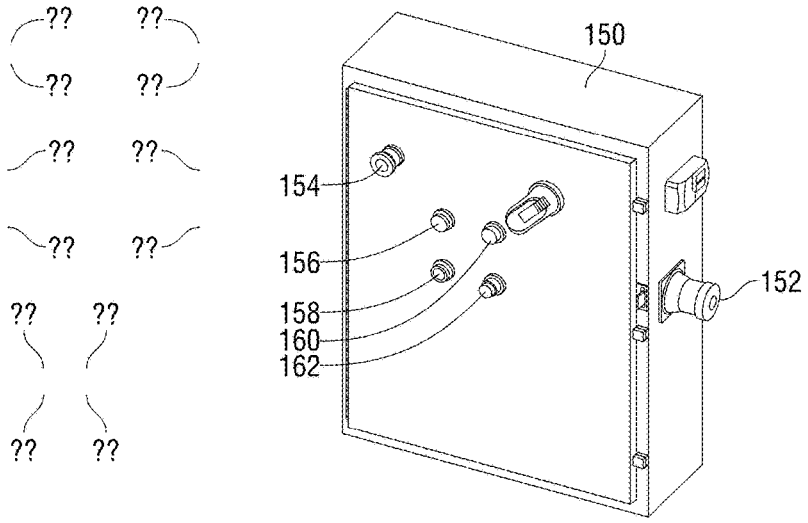
Figure 13:
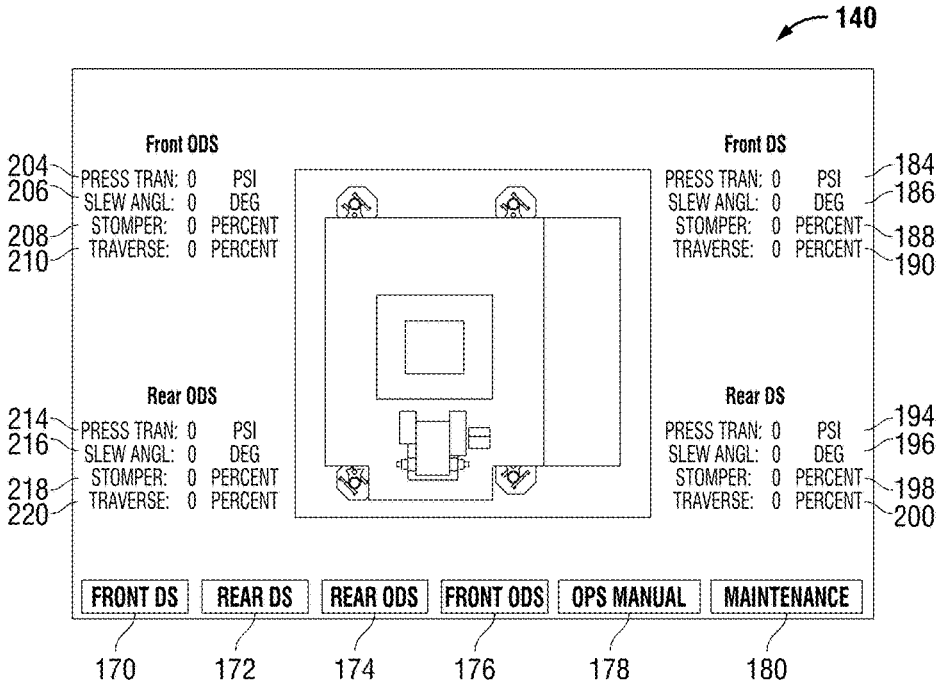
Figure 14:
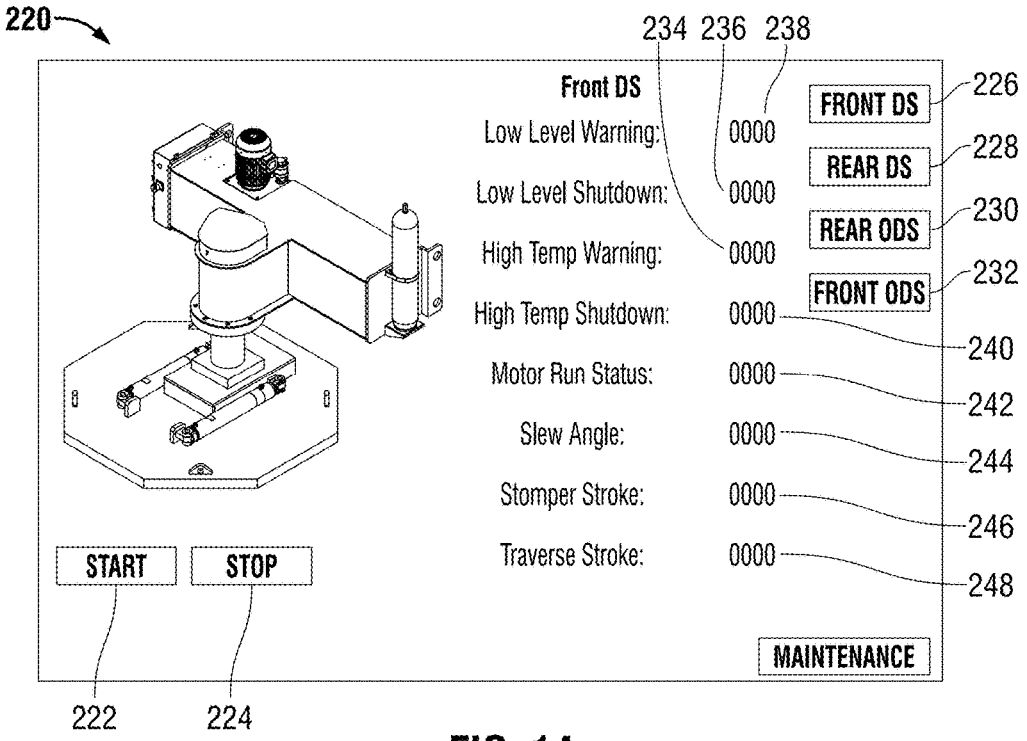
Figure 15:
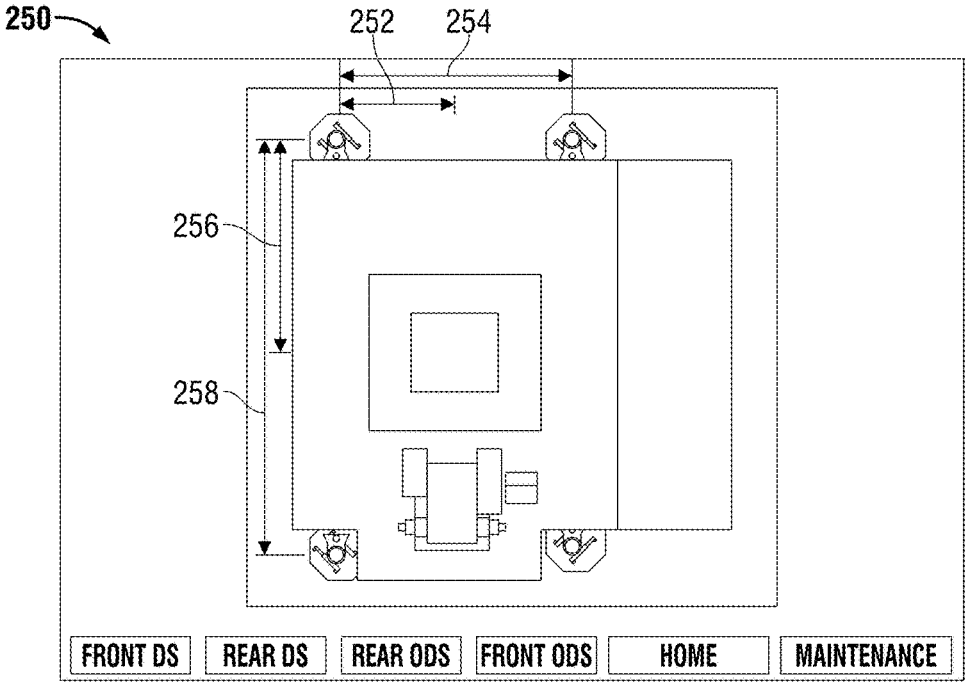

Having thus described the invention in general terms, reference will now be made to the accompanying drawings, which are not necessarily drawn to scale, and wherein:

FIG. 1 illustrates a drilling rig which may be used for energy production in an oil field or similar venue using the presently disclosed subject matter;

FIG. 2 illustrates in further detail the attachment of the presently disclosed positioning shoes at the base of a drilling rig;

FIG. 3 depicts a top down perspective of a drilling rig to illustrate the orientation and positioning of the positioning shoes at the four corners of the drilling rig;

FIG. 4 illustrates an important aspect of the presently disclosed system for moving a drilling rig;

FIGS. 5A, 5B, 5C, 5D, 5E, and 5F illustrate the positioning, control and operations available through the use of present independently-controlled positioning shoe;

FIG. 6 illustrates the positioning shoe hydraulics control unit for controlling a cylinder stomper, as herein described;

FIG. 7 illustrates a cylinder stomper according to the teachings of the present disclosure;

FIGS. 8 and 9 depict rear perspective views of the positioning shoe hydraulics unit;

FIG. 10 illustrates a wireless remote control device for controlling the operation of the presently disclosed positioning shoe;

FIG. 11 illustrates an enclosure for operation of positioning shoe according to the presently disclosed method and system;

FIG. 12 illustrates a starter enclosure for initiation of positioning shoe operations;

FIG. 13 illustrates a HMI home screen for controlling and monitoring the operation of a complete positioning shoe system according to the present teachings;

FIG. 14 illustrates an individual screen controller for use selection on of the individual shoe buttons on the bottom of the present HMI home screen; and FIG. 15 provides an interface for indication and control of pivot operating for the presently disclosed positioning shoe.

DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all the possible embodiments and contexts of the invention in this disclosure. Upon reading this disclosure, many alternative embodiments of the present invention will be apparent to persons of ordinary skill in the art.

FIG. 1 illustrates drilling rig 10 which may be used for energy production in an oil field or similar venue. Drilling rig 10 includes superstructure 12 and platform 14. On platform 14 appears operator shack 16. In operator shack 16 reside controls, information, maps and office space for performing the operations necessary to operate and reposition drilling rig 10. Beneath platform 14 appear structural members 18 which provide physical support for drilling rig 10 as drilling apparatus drills for and employs equipment to explore subterranean energy resources. At the base of drilling the base 20 of drilling rig 10 Are positioning shoes 22 positioning shoes 20 to provide an essential aspect of the novel features and functions of the present disclosure.

FIG. 2 illustrates in further detail the attachment of positioning shoes 22 at base 20 of drilling rig 10. Note that the drilling rig 10 shows four positioning shoes 22 attached at points 24, 26, 28, and 30 of base 20. Depending on drilling rig 10, other configurations may be used. For example, six, eight, or more attachment points on a particular drilling rig may be used. For purposes of the present disclosure, however, four positioning shoes 22 are illustrated in FIG. 2.

FIG. 2 depicts target area 29 over which the drilling rig may be precisely located using the presently disclosed method and system. Once the drilling rig reaches target area 29, the operator may take further steps to position drilling rig 10 at the desired location. But furthermore, because of the rotation made possible With the presently disclosed positioning shoe 22, the operator may fully pivot or rotate drilling rig 10 by wireless control to positioning shoes 22. The electronic, electrical, and mechanical componentry and their operation and use, as herein describe make clear how the presently disclosed subject matter achieves these results.

In operation, positioning shoe 22 is bolted, pinned or otherwise attached to the frame of drilling rig 10. Then, a 480 V power supply is connected to each of the attached positioning shoes 22. The 480 V power supply would most likely come from a generator set positioned on drilling rig 10. Then, a controller unit, as herein described, which probably will be located with in operating shack 16, will control positioning shoe 22 operations.

A drilling rig operator may use a wireless remote controller, as described below, to control operation of positioning shoes 22. Thus, for example, if a 1½ mile reposition is required, the operator may map out an appropriate path from the present position to the position 1½ miles away. Using the wireless controller the operator may control the movement of positioning shoe 22 and the angle or path that the positioning shoe 22 takes to complete the 1½ mile repositioning.

Another aspect of the presently disclosed positioning shoe 22 system relates to the plug-and-play configuration of each positioning shoe. Thus, in the event that a portion fails to render positioning shoe 22 inoperable, the drilling crew may unpin the failed positioning shoe 22 and replace it with a new operational positioning shoe. Then, the wireless controller may be associated with the newly installed positioning shoe 22, simply through a change in the controller's programmed IP address for use in working with the program logic controller.

A particularly important aspect of the presently disclosed positioning shoe 22 relates to their selectably independent and/or slaved vertical, lateral, and rotational variability, as will be described below. By operating independently, the overall system becomes more reliable and more flexible. This is because movement of a drilling rig does not rely upon all four of the positioning shoes to operate together or that they be physically interlinked in order to reposition the drilling rig.

In the present embodiment of the disclosed subject matter, positioning shoes 22 have the ability to reposition drilling rig 10 weights of between 650,000 and 850,000 pounds. In the present system, the weight capacity is 1,200,000 pounds. With each step of a positioning shoe 22, a distance of approximately 1 yard may be moved. In practice, therefore, it is possible to move the drilling rig with the disclosed positioning feet up to 1 mile within an 88 hour period to reposition such a weight and structure.

FIG. 3 depicts a top down perspective of drilling rig 10 to illustrate the orientation and positioning of the position shoes 22 at the four corners of drilling rig 10. As previously introduced, platform 14 supports operator shack 16 and provides a base upon which superstructure 12 may be supported. Of importance in FIG. 3 is the indication of wireless technology signals 32, 34, 36 and 38. Here, it is to be understood that each positioning shoe 22 is capable of receiving and sending a separate wireless signal using an onboard controller residing on positioning shoe 22. Thus, a wireless controller will operate remotely in, for example, operator shack 16, to communicate with a paired wireless controller built into positioning shoe 22.

The wireless control of the presently disclosed system may operate positioning shoe 22 at a range of up to 350 feet. Wireless control permits the operator to change the direction and height of positioning shoe 22 separately, according to the demands of the terrain on which an operator positions the drilling rig. At the same time, all of the positioning shoes may be slaved to one another and to a single controller so that their operation is in harmony or unison as they move from one field position to another.

FIG. 4 illustrates an important aspect of the presently disclosed positioning shoe 22 system for moving drilling rig 10. Consider an energy production field 40, as depicted in FIG. 4. Energy production field 40 may include numerous points whereupon drilling rig 10 may be positioned. For example, at Point. A, drilling rig 10 may be positioned at an upper or higher elevation. At Point B, drilling rig 10 may be moved to a lower elevation. Then, drilling rig 10 may be move to a further Point C, where new drilling may occur. Finally, at Point D, drilling rig 10 may be for the position.

Note that it each of Points A, B, C, and D, for example, the terrain of oil field 40 may vary both in elevation and slope. An important aspect of the positioning shoe 22 system of the present disclosure is the ability to accommodate these variations. This is because each of the positioning shoes 22 on drilling rig 10 can assume a height that is separate and distinct from that of the other drilling shoes 22. This individual control of each positioning shoe 22 on drilling rig 10 allows for more rapid and flexible placement up a drilling rig has exploration energy resources occurs in an energy resource field.

The individual control and variation of each positioning shoe 22 avoids a significant problem associated with known systems wherein a position change of the drilling rig requires that all operations on the drilling rig must cease. The time necessary to unpin the known positioning shoes and, if needed, vary the hydraulic feed to unpin the associated hydraulic feed requires that workers stop operations on the drilling rig. This can be very expensive in terms of idle drilling operation employees as the control and manipulation of the known positioning shoes changes. The presently disclosed ability of positioning shoe 22 system to avoid this downtime provides a valuable asset to the energy resource producer.

A further aspect of the present method and system includes programming flexible engendered by the independent wireless communication to each positioning shoe 22 on drilling rig 10. For example, some machine learning applications may permit automated or preprogrammed repositioning of drilling rig 10. With an analysis of the terrain on which the drilling rig is operating, potential movement algorithms could be stored in the controller processing memory for execution in a planned or responsive fashion according to the field dynamics.

FIGS. 5A, 5B, 5C, 5D, 5E, and 5F illustrate the positioning, control and operations available through the use of independently controlled positioning shoe 22. The movement of drilling rig 10 can be determined by the lateral and rotational movement of positioning shoe 22 and the vertical variation of the cylinder stomper 42 on positioning shoe 22 as the positioning shoe 22 move along a desired path.

Figure 5A:
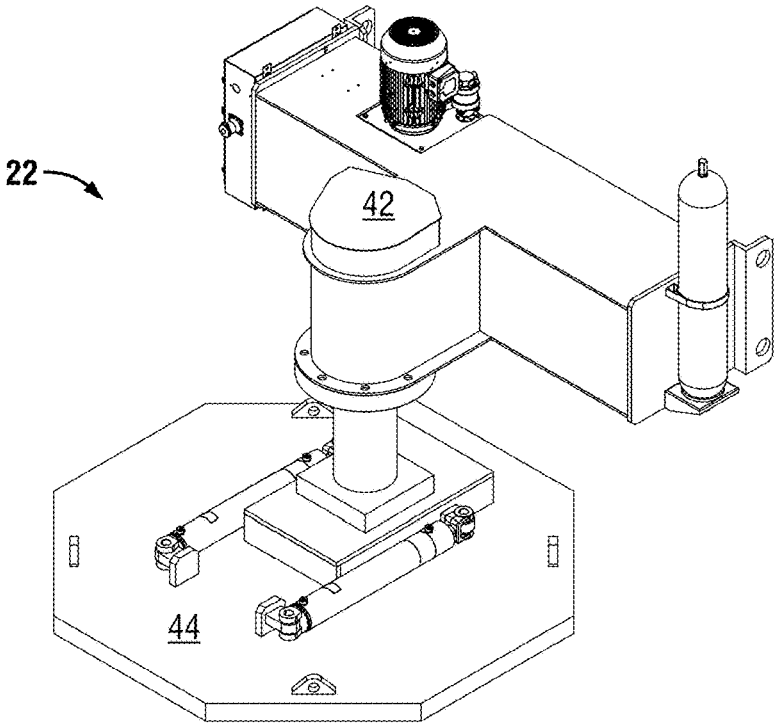
Figure 5B:
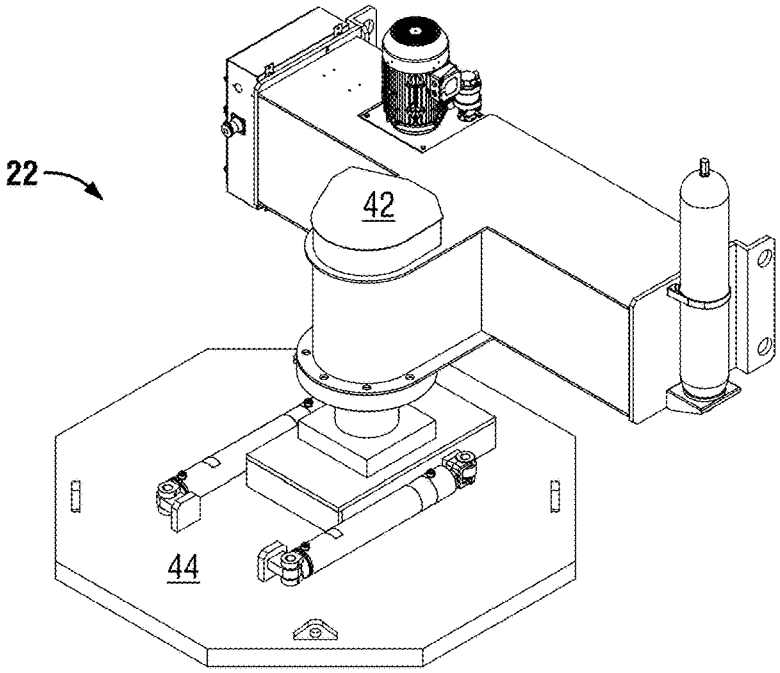
Figure 5C:
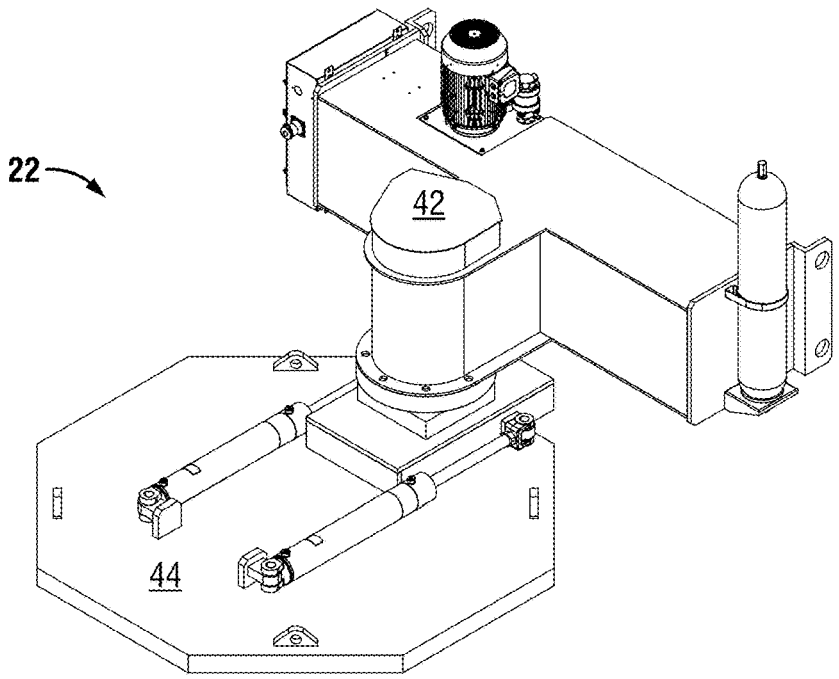
Figure 5D:
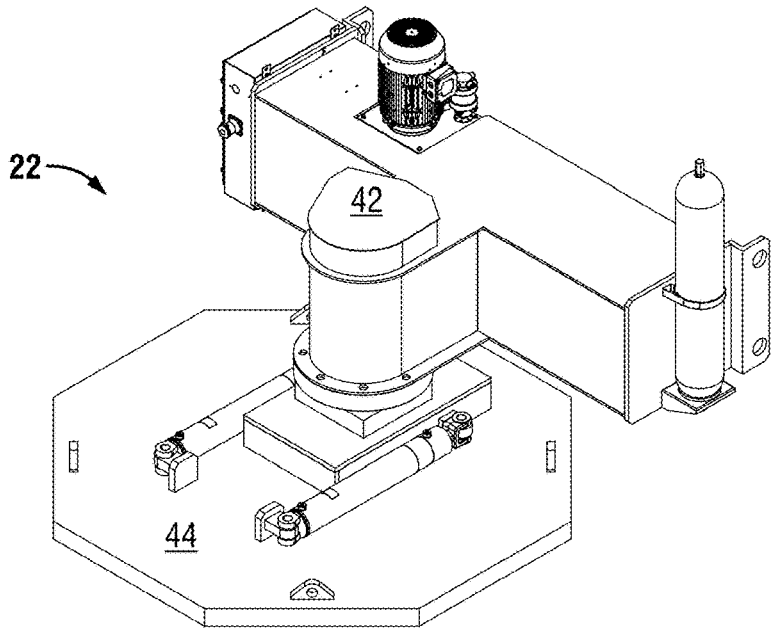

Thus, FIG. 5A illustrates that positioning shoe 22 engages the ground by virtue of cylinder stomper 42 extending to bring foot 44 with the ground. FIG. 5B shows that with the retraction of cylinder stomper 42, positioning shoe 22 ground contact ceases as foot 44 draws upward. Elevating foot 44 provides the greatest freedom of movement of foot 44 beneath cylinder stopper 42. FIG. 5C illustrates that, by virtue of moving traverse cylinders 46, positioning shoe 22 can take a first position. Then, with the contraction of traverse cylinder 46, foot 44 assumes a different position enabling lateral movement in positioning shoe 22. Repeated extension and contraction of traverse cylinders 46 provides the necessary lateral movement for positioning shoe 22 42 to operate.

Figure 5E:
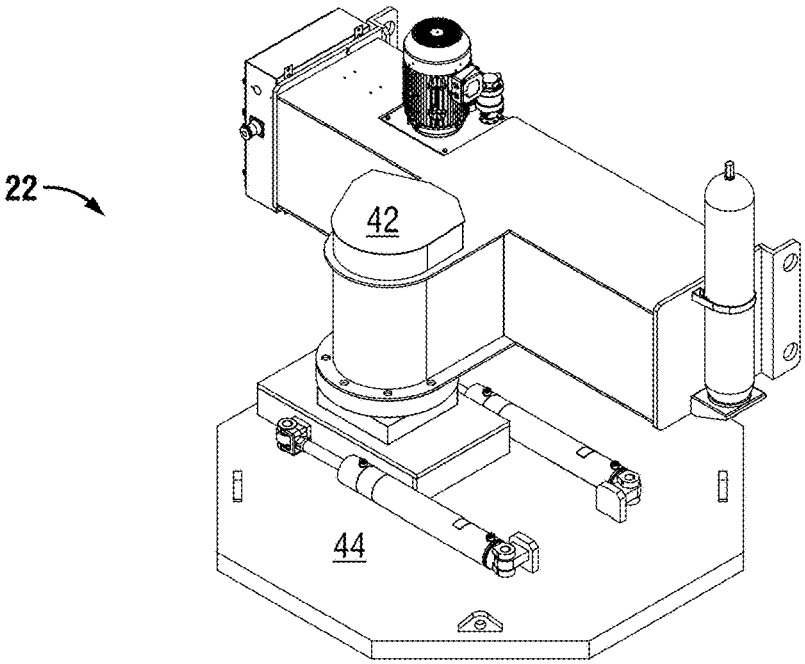
Figure 5F:
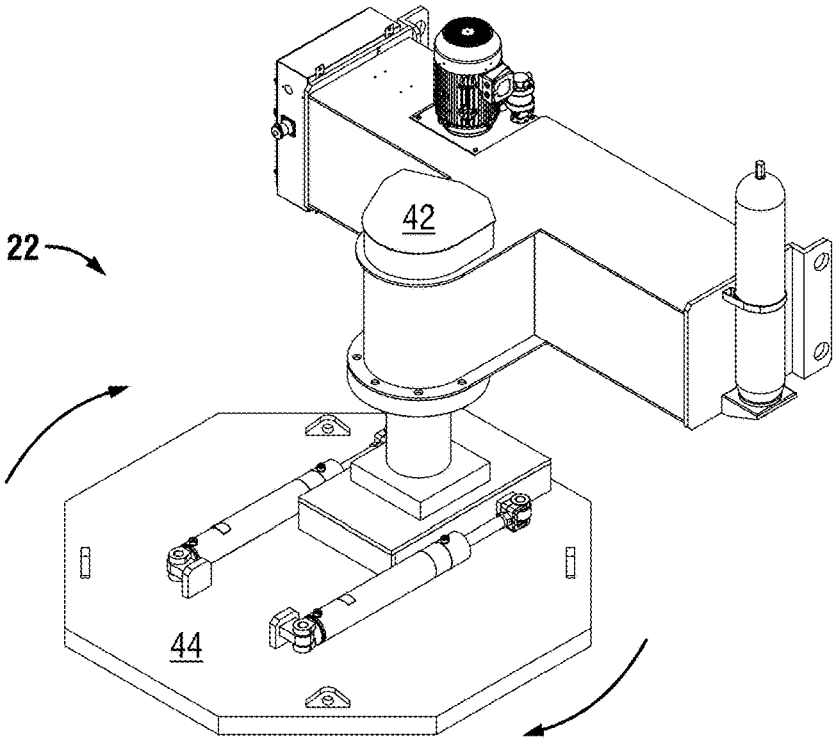

FIGS. 5E and 5F further show that by virtue of rotating cylinder Stomper 42, 4044 may rotate. The rotational motion of cylinder stamper 42 to Carrs foot 40 Fort to pivot is an added feature of the present does presently disclosed system and arises bayous by use of a sloughing deer in conjunction with positioning shoe 22 control circuitry to cause the rotation of cylinder stopper 44. The rotation of cylinder stopper 42 in conjunction with the operation of feet 44 on positioning to shoe 22 enables the rotational motion of positioning shoe 22. These operations over completely described and explained below.

An aspect of the independently-addressable positioning shoe 22 of the present disclosure is the ability to walk all positioning shoes 22 on drilling rig 10 collectively using wireless command controls. With wireless commands, an operator may walk or independently and remotely re-position the entire drilling rig from a first position to a second position. The commands for performing these movements derive from an operator controller wireless signals which positioning shoes 22 receive and to which they respond. By virtue of providing independent communication and control of each positioning shoe, the presently disclosed system may walk the rig in an arc or curved path. This also permits the ability to respond to more varied landscapes as the drilling rig moves to various positions in the oil field.

An example on independent rotational control of positioning shoe 22 may be as follows. One positioning shoe 22 may need to to rotate the shoe 22 270°, while the other positioning shoes 22 may require only a 90 or 180° rotation. By virtue of the ability to vary the rotation range of each individually addressable position shoe 22, a nonlinear directional position is possible. Thus, the independently controllable and addressable positioning shoes 22 may permit the drilling rig to completely rotate at a fixed position on the oil field to rotate a reposition it's orientation in whatever direction the operator may desire.

FIGS. 6 and 7 identify the essential operative components of positioning shoe 22. In particular, FIG. 6 identifies self-contained hydraulic power unit 48 and onboard control mechanism 50. In addition, wireless control unit 52 permits communication between a central controller described below and onboard control mechanism 50. FIG. 7 provides a diagram of cylinder stomper 42 which includes housing 54 and slewing gear mechanism 56. The operation of self-contained hydraulics power unit 48 and onboard controls 50 by wireless controls 52, and the rotational and vertical control provided by slewing mechanism 56 and cylinder stopper 54 and vertical housing 54 are provided more clearly below.

Self-contained HPU 48 and cylinder stomper 42 include positioning devices that provide position feedback information. A feedback mechanism within self-contained HPU 48 and wireless controls 52 provides for feedback and response signals relating to both linear and rotational motion of feet 44 of positioning shoe 22. Prior art positioning shoes may provide feedback in a straight linear direction. However, positioning shoe 22 provides in self-contained HPU 48 and onboard controls 52 the ability to respond to rotational and vertical changes, as well as linear changes. With positioning shoe 22 system of the present disclosure, roll, pitch, and yaw measurement may be provided by sensors within the positioning shoe. This results in a much more accurate determination of the configuration of rig and the position changes across the field.

The feedback mechanism in positioning shoe 22 senses the rotation of feet 44. Accordingly, when self-contained HPU 48 and onboard controls 52 responds to a command to rotate foot 44 by a specific number of degrees, the feedback system can measure whether that number of degrees has in fact been rotated. Known positioning shoes do not provide infinite variability in the angle of rotation for the feet. Such configurations do not also provide for wireless control of the feet for independent positioning.

Another aspect of the present disclosure relates to the operational characteristics of the actuators within the positioning shoe 22 hydraulic control components. By virtue of a warming circuit within the actuators, reliability increases, while minimizing adverse effects of severe temperature changes. Temperature differences between warm oil that may be in the field and the cold atmosphere that may exist on the drilling rig out above this earth surface. The actuator mechanism of the present disclosure includes a circuit that warms the actuator and the positioning feet as they operate in colder environments. All diagnostic sensing and data controls operates in the HPU unit. This includes pressure transducers, temperature sensors, and other parameters associated with the performance of the positioning shoe.

FIG. 7 illustrates cylinder starter 42 according to the teachings of the present disclosure. Cylinder stop at 42 includes encoder 66 and skewing motor 68. Slewing gear 68 controls the operation of sloughing gear 70. Slewing gear 68 controls the rotational angle and angular feedback and control that pivots cylinder stomper 42. Slewing gear 68 involves driving a rack and pinion arrangement that rotates cylinder stomper 42 to cause the attached hexagonal feet 44. Slewing gear 68 allows for rotating feet 44 with as little friction and minimal energy consumption as possible with rotational or pivot motion is required for drilling rig 10 movement. This is because the rotation occurs when foot 44 is elevated and out of contact with the ground.

FIG. 8 depicts the rear perspective view of hydraulic unit 58. Hydraulic unit 58 includes DS motor 48 and LVDT 56 of cylinder stomper 42. In addition, starter enclosure 72 amounts to hydraulic unit 58.

FIG. 9 shows a close-up view of the rear portion of hydraulic unit 58. In particular, DS motor 48 operates pressure transducer 76. Also, alongside DS motor 48 appears low level warning switch 78 and high temperature shut down switch 80. Valves associated with control unit 58 include stomper valve 82, traverse cylinder valve 84, and slew valve 86

FIG. 10 illustrates a wireless remote control device for controlling the operation of positioning shoes 22 in a given drilling rig 10 configuration. Wireless remote control unit 90 provides wireless remote control panel 92. Wireless remote control panel 92 provides numerous finger actuated controls for operation of positioning shoes 22. To begin, on/off switch 94 controls the operation of wireless remote control unit 90. Emergency stop or E-stop switch 96 provides emergency stop actuation for positioning shoot 22. Dead man button 98, and slew angle potentiometer 100 control the operations of positioning shoe 22. Variable controls for positioning shoe 22 from wireless remote control panel 92 include pivot joystick 102, traverse cylinder joystick 104, and stomper joystick 106. Six-position selector switch 108 permits the operator to select which positioning shoe 22 will receive wireless control signals. Thus, six-position selector switch 108 may select DS front position 110, DS rear position 112, auto position 114, ODS rear position 114, and ODS front position 116. Moreover, and "ALL" or slave position 118 may be selected using six-position selector switch 108.

FIG. 11 illustrates enclosure 130 for operation of positioning shoe 22 according to the presently disclosed method and system. Enclosure 130 includes lid 132 and base 134. Within base 130 are power and control input panel 136. In particular, control inputs include HMI screen 140 that provides input and control signals operation of positioning shoes 22. Power socket 142 provides power to enclosure 130. Power light 144 indicates the status of the controller. On/Off selector switch 146 controls power to controller 130. Receiver and transmitter 148 receives wireless communication signals from the onboard wireless communication circuitry aboard positioning 22.

FIG. 12 illustrates starter enclosure 150 for initiation of positioning shoe 22 operation. Starter enclosure 150 includes power receptacle 152. Controls on starter enclosure 150 include E-stop button 154, on/off switch 156, power on button 58, manual stop button 160 and manual start button 162.

FIG. 13 illustrates home screen or HMI home screen 140. Across the bottom of HMI home screen 140 appear buttons for control of respective positioning shoes 22. These include FRONT DS button 170, REAR DS button 172, REAR ODS button 174, FRONT OGS button 172, OPS manual button 178, and MAINTENANCE button 180. HMI home screen 140 further includes respective indicators for positioning shoes 22. Thus, for FRONT DS positioning shoe 22 182, FRONT DS indicators include pressure transducer indicator 184, slew angle indicator 188, stomper indicator 188, and traverse cylinder indicator 190. REAR DS positioning shoe 22 192 provides indicators for pressure transducer indicator 194, slew angle indicator 196, stomper position indicator 198, and traverse cylinder position 200. FRONT ODS positioning shoe 22 202 provides indicators for pressure transducer 204, slew angle indicator 206, stomper indicator 208, and traverse cylinder indicator 210. We are REAR ODS positioning shoe 22 212 provides indicators for pressure transducer 214, slew angle indicator 216, stomper indicator 218, and traverse cylinder indicator 220.

FIG. 14 illustrates an individual screen 220 controller for FRONT DS selection ON/OFF the previously identified buttons on the bottom of HMI home screen 140. For example, on pressing FRONT DS button 170 from FIG. 13 of HMI home screen 140, FRONT DS screen 220 of FIG. 14 appears. FRONT DS screen 220 provide control input for positioning shoe 22 at front DS location 202.

Controls for starting FRONT DS position 182 the operator presses on individual FRONT DS screen 220, FRONT DS START button 222. For stopping FRONT DS position 182 the operator presses STOP button 224. FRONT DS screen 220 also provides buttons for moving or navigating to other screens with in the controller. These include HOME button 226, REAR DS button 228, REAR ODS button 230, and FRONT ODS button 232. FRONT DS screen 220 provides indication of the status of positioning shoe 22 at the FRONT DS location 202. These include low-level warning indicator 234, low level shutdown indicator 236, and high temperature warning indicator 238. Moreover, indicators are provided for high temperature shot down indication 240, motor runs status 242, slough angle to 44, stop or stroke 246, and traverse number one stroke 248.

These commands issue from a main controller to the individual positioning shoes 22. The controller of the present system employs a bus to make possible the necessary feedback and control to independently and/or collaboratively control positioning shoes 22.

FIG. 15 also provides indication pivot operating with positioning shoe 22. This indicates $L_p$ indicator 252, L indicator 254, $W_p$ indicator 256, and W indicator 258.

The following description addresses various uses of the presently disclosed system and method. Using the waist control unit, the sequence of operations may be as follows: INDIVIDUAL MODE-All four of the walking feet will be attached to the rig and the starter enclosures 50 connected to 480 VAC power via a power receptacle 152. Each starter enclosure 50 will have two dipswitches located inside the starter enclosure 50. The operator must ensure that the dipswitches are set to the following settings (Front DS=00, Rear DS=10, Rear ODS=01, Front ODS=11), this will tell what the location of each foot on the rig.

The On/Off switch 156 located on the starter enclosure 50 will be turned to the "ON" position, and the power on light 158 should illuminate. Repeat until all 4 of the enclosures have been powered on. Ensure the E-stop button 154 on the starter enclosure is not depressed.

The wireless HMI screen 140 housed in a Pelican case enclosure 130 should be pulled out of storage, the power cord plugged into the power socket 142, and the ON/OFF selector switch 146 should be turned to the "ON" position. The HMI screen 140 should power on and the Power On light 144 should illuminate. Once the Pelican case enclosure 130 is powered on the wireless receiver 148 will begin communicating with an identical wireless receiver 148 located on each walking foot.

The wireless remote control 92 should be taken out of storage, the ON/OFF switch 94 turned to the ON position, and the E-stop 96 disengaged. Using the HMI Screen 140 click the "FRONT DS" Button 170 on the bottom of the HMI Home 140 screen. Once on the Front DS Screen 220 hit the "START" button 222 on the lower left-hand side of the screen to start the front DS motor. By hitting the "STOP" button 224 on the lower left-hand side of the screen the operator may stop the front DS motor 48. If the operator does not want to start the motor remotely from the HMI screen 140 the manual "START" 162 and "STOP" 160 buttons located on each starter enclosure 50 could be used to locally start the motor.

Once the front DS motor 48 has been started using the wireless HMI screen 144, the operator can use the wireless remote control 92 to position the Front DS Foot. Using the 6-position selector 108 switch the operator will select the "FRONT DS" mode 110.

Using the HMI Screen 140 the operator can check the HPU system status for the front DS walking foot. Status of the Front DS walking foot can be found on the front DS page 220 and is covered by items (234, 236, 238, 240, 242, 244, 246, 248). If all status read ready and within accurate parameters, the operator is free to begin positioning the walking foot.

Using the wireless remote control 92, ensure the slew potentiometer 100 is set to 0 degs. Next begin to slowly extend the stomper joystick 102 while holding the deadman button 98. If either the stomper joystick 102 or deadman button 98 are released the stomper valve 82 will return to center and the stomper cylinder 56 will stop extending. The traverse joystick 104 and slew potentiometer 100 cannot be operated when the stomper joystick 102 is engaged. Only one operator on the wireless remote control 92 may function at a time.

Once the stomper cylinder 56 is extended approximately 75% of the full cylinder stroke the operator may, if they wish, change the angle of the slew drive by adjusting the slew potentiometer 100 while holding the deadman button 98. By adjusting the slew potentiometer 100 the slew valve 86 will open thus rotating the slew motor 68 to the desired angle. The percentage of the stomper cylinder stroke can be seen on either the home screen 140 of the HMI 140 or on the individual foot page 220. See item 188 and item 246 respectively. The stomper cylinder 56 on each foot contains an LVDT 56 which will accurately measure the stroke of the cylinder as it extends and retracts. Th operator cannot control the stomper joystick 102 at the same time as the slew angle potentiometer 100, so the operator must first release the stomper joystick 102 once the operator has reach 75% of the full cylinder stroke.

After the slew angle 186 or 244 has been adjusted the operator can retract the stomper cylinder 56 to the starting position using the stomper joystick 102 and the deadman button 98. The operator can also tell if the stomper cylinder 56 is fully retracted on the home page 140 of the HMI screen 140 or on the individual foot page 220. See item 188 and item 246 respectively. The slew angle can be seen on either the home page 140 of the HMI screen 140 or on the individual foot page 220. See item 186 and item 244, respectively. The slew drive 68 on each foot contains an encoder 66 which will accurately measure the angle of each slew drive as it rotates CW or CCW.

Ensure the traverse cylinder 60 is retracted and in the starting position. The operator can tell if the traverse cylinder 60 is fully retracted and in the starting position by looking at the home page 140 of the HMI screen 140 or on the individual screen 220. See item 190 and items 248 respectively. One of the traverse cylinders 60 on each foot contains a LVDT 64 which will accurately measure the stroke of the cylinder as it extends and retracts. The operator can adjust the traverse valve 84 and traverse cylinder 60 by using the traverse joystick 104 and the deadman button 98 in conjunction. The traverse joystick 104 cannot be operated at the same time as the stomper joystick 102 or the slew potentiometer 100.

After the Front DS foot has the appropriate angle set and the stomper cylinder 56 and traverse cylinders 60 are fully retracted and in the starting position, repeat steps 6 through 14 for the other 3 legs ("REAR DS" 112, "FRONT ODS" 116, "REAR ODS" 114)

Operations may occur also in an "ALL MODE" as follows: Once the setup and maintenance checks have been completed for each of the individual rig walking feet, the rig walking system is ready to be used in "ALL" mode. Move the 6-position selector switch 108 on the wireless remote control 92 into the "ALL" Mode 118. The angle of the slew drive 68 should have been set for each foot in the individual mode (34*a*, 34*b*, 34*d*, & 34*e*) The operator is now ready to walk the rig. By holding down the stomper joystick 102 and holding the deadman button 98 the operator should be able to extend the stomper cylinders 56 until the end of stroke is reached. End of Stroke can be found on the home screen 140 of the HMI screen 140 or on the individual screens 220.

Once the end of stroke is reached on the stomper cylinder 56. The operator should release the stomper joystick 102 and move to extend the traverse joystick 104 while holding down the deadman button 98. The traverse cylinder 60 will extend till the end of stroke is reached. End of Stroke can be found on the home screen 140 of the HMI screen 140 or on the individual screens 220. Once the traverse cylinder 60 if fully extend the operator should release the traverse joystick 104 and deadman button 98.

The operator can now lower the rig by moving the stomper joystick 102 in the downward direction while holding the deadman button 98. Once the stomper cylinder 56 has reached end of stroke the operator can release the stomper joystick 102. End of Stroke can be found on the home screen 140 of the HMI screen 140 or on the individual screens 220.

The operator can retract the traverse cylinder 60 by moving the traverse joystick 104 in the downward direction while holding the deadman button 98. Once the traverse cylinder 60 has reach end of stroke the operator can release the traverse joystick 104. End of Stroke can be found on the home screen 140 of the HMI screen 140 or on the individual screens 220.

Repeat steps 14 Thru 17 until the rig has reached the desired destination or an individual adjustment is required.

If the angle in which the rig is walking needs to be adjusted this can be done in "ALL" mode 118 by extending the stomper cylinder 56 to approximately ¾ of stroke and then letting go of the stomper joystick 102. While holding the deadman button 98 the operator can adjust the slew angle to the desired trajectory using the slew potentiometer 100. When the operator is finished adjusting the slew angle 186, 42, 53, & 57) the operator can resume extending the stomper cylinder 56 to full stroke.

Yet a further operations mode is the "AUTO MODE," which takes place as follows: If the operator would like to use the rig in "AUTO" mode 120, then the operator will first need to adjust the slew angle 186, 42, 53, & 57) of the rig in "ALL" mode 118. Once the rig is pointed in the correct direction the operator can move the 6-position selector switch 108 into "AUTO" mode 120.

The operator should hold down the deadman button 98 and hold the traverse joystick 104 in the extend position and the rig will walk in a lift, traverse extend, lower, traverse retract cycle until the operator either releases the traverse joystick 104 or deadman button 98.

Positioning shoe 22 of the present disclosure may operate in a "PIVOT MODE" as follows: If the operator would like to pivot the rig which is a pre-programmed turning of the rig around the well head. The operator must first go to the "PIVOT" screen 250 and enter the following values W 258, WP 256, L 254 and LP 252. After these values for the rig floor dimensions have been entered the rig will be ready to pivot.

Before performing the pivot operation, the operator will ensure that the stomper 56 & traverse 60 cylinders are in the starting positions and that the slewing motor 68 is set to a 0° angle. Once this has been checked the operator will set the 6-position selector switch 108 on the wireless remote control 92 to "AUTO" mode 120. Once in "AUTO" mode 120 the operator will simply hold down the deadman button 98 and extend or retract the pivot joystick 102 to pivot the rig in the CW or CCW direction.

Once the pivot maneuver has been completed the operator can release the pivot joystick 102.

The pivot formula is as follows:

a. FODS 116

$$\theta RODS=\tan-1(LP/WP)$$

$$CCWFODS=\theta FODS+90°$$

$$CWFODS=\theta FODS-90°$$

b. FDS 110

$$\theta FDS=\tan-1(WP/(L-LP))$$

$$CCWRDS=\theta RDS+90°$$

$$CWFDS=\theta RDS-90°$$

c. RDS 112

$$\theta RDS=\tan-1((L-LP)/(W-WP))$$

$$CCWRDS=\theta RDS+90°$$

$$CWRDS=\theta RDS-90°$$

d. RODS 114

$$\theta RODS=\tan-1((W-WP)/(LP)$$

$$CCWRODS=\theta RODS+90°$$

$$CWRODS=\theta RODS-90°$$

The positioning shoe 22 system of the present disclosure includes a number of INTERLOCKS as follows:

Low level warning switch 78—when activated on any leg will send a warning error to the main HMI screen. On the Individual screen 220 item 234 will change status to warning.

High temp warning switch 78—when activated on any leg will send a warning error to the main HMI screen. On the Individual screen 220 item 236 will change status to warning.

Low level shutdown 80—When activated will kill power to the leg affected by the low-level shutdown and deactivate controls to the other legs.

High temp shutdown 80—When activated will kill power to the Leg affected by the high temp shutdown and deactivate controls to the other legs.

Motor running status—The motor must be operational before any of the controls on the wireless remote control will operate. In "ALL" 118 and "AUTO" 120 mode all 4 motor run status's must be present in order to operate the wireless remote control 92.

E-stop signal 148—If the e-stop on the wireless remote control 92 is depressed then the base will send a signal to the PLC which will immediately deactivate the controls for each leg of the walking system.

E-stop on enclosure 50—in "ALL" 118 or "AUTO" 120 mode if an E-stop 152 is depressed on any enclosure then it will disconnect power to the enclosure with the depressed e-stop and the other 3 legs will have their controls deactivated.

To operate any of the stomper 102 or traverse 104 joysticks or slew potentiometer 100 on the wireless remote control 92 the deadman button 98 must be depressed. The deadman button 98 will eliminate accidental shifting of the valves (19, 20, & 21). Only one of the joysticks (31, 32, & 33) or potentiometer 100 can be operated at a time. Example: If the stomper joystick 102 is in operation then the traverse joystick 104, the pivot joystick 102 or the slew potentiometer 100 can be moved but they will not operate the traverse valve 84 or the slew valve 86.

Pressure transducer 76—must be present and reading a value of at least 2500 or a predetermined minimum pressure required by the load of the equipment being moved before any walking leg can be operated. The pressure readout can be found on the home screen 140 of the HMI screen 140 These values are shown by item numbers (184, 194, 214 & 204). The slew drive 68 can only be engaged when the stomper cylinder 56 is within 2" of end of stroke (I.e. the rig is 2 inches off the ground). The stomper cylinder stroke values can be found on the home screen 140 of the HMI screen 140 or on the individual foot screen 220. The respective values can be found under the following item numbers (188, 198, 218, & 208) & 246

Stomper cylinder feedback 56—a signal will be sent back to the PLC which details the position of the stomping cylinder 56. The analog input value must be present, or the walking system will not operate.

Traverse cylinder feedback 64—a signal will be sent back to the PLC which details the position of the traversing cylinder 60. The analog input value must be present, or the walking system will not operate.

Slew Motor Feedback 66—a signal will be sent back to the PLC which detail the angle of the slewing motor 68. The analog input value must be present, or the walking system will not operate.

Another aspect of the present disclosure includes the potential for incorporating machine learning as a result of the operation. Thus, with the ability to record and document a particular move from one position in energy field oil field to another, there is the ability to learn what worked well and what did not. This can be incorporated into a set of data points or tables that would indicate best modes of operating. With this machine learning capability, improved operations for the presently disclosed system are possible.

A further use of the learning capabilities and data logging is the ability to conduct a failure analysis on the system, operation, and conditions.

In the PLC or program logic controller, there is a separate address separate IP address for every foot. For every positioning shoe. Accordingly, the PLC has the ability to communicate directly to the IP address for a specific positioning shoe. This permits the positioning shoe 22 to be controlled using the single PLC for all four of the feet.

In addition to use in an oil field for moving drilling rigs, the method and system of the present disclosure may be used for other applications. Such other applications may include, for example, the shipbuilding industry or large structures that must be moved from one place to another to perform different types of operations on a ship in a dry dock or other facility. Yet another application of the presently disclosed positioning shoe 22 configuration may be to reposition blowout preventer's (BOP) in an operational environment.

The benefits and advantages that may be provided by the present invention has been described above regarding specific embodiments. These benefits and advantages, and any elements or limitations that may cause them to occur or to become more pronounced are not to be construed as critical, required, or essential features of any of any or all of the claims. As used herein, the singular forms "a", "an", and "the" are intended to include the plural forms as well, unless the context clearly indicates otherwise. It is further understood that the terms "comprises" and/or "comprising" or "includes" and/or including", or any other variation thereof, are intended to be interpreted as nonexclusively including the elements or limitations which follow those terms. Accordingly, a system, method, or other embodiment that comprises a set of elements is not limited to only those elements, and may include other elements not expressly listed or inherent to the claimed embodiment. These terms when used in this specification, specify the presence of stated features, regions, integers, steps, operations, elements, and/or components, but do not preclude the presence or addition of one or more features, regions, integers, steps, operations, elements, components, and/or groups thereof.

What is claimed is:

1. A drilling rig mobility system for moving a drilling rig in an oilfield, comprising:

a plurality of independently controllable positioning shoes for attaching to the drilling rig and through separate and coordinated position control commands to each of said plurality of independently controllable positioning shoes repositioning the drilling rig, each of said independently controllable positioning shoes further comprising:

a housing attached to the drilling rig and providing structural enclosure for containing a hydraulic actuator and wireless control circuitry, said hydraulic actuator for providing vertical, horizontal and rotational force in response to wireless control signals from said wireless control circuitry;

said wireless control circuitry for communicating wireless position and control data and instructions with a remote wireless communications device and converting said wireless position and control data and instructions to hydraulic actuator control signals;

a positioning shoe cylinder stomper for vertically elevating said hydraulic actuator and for receiving and transferring said vertical and rotational force from said hydraulic actuator;

a positioning shoe foot assembly rigidly connected to said positioning shoe cylinder stomper and associated to receive and transfer said horizontal force from said hydraulic actuator;

a positioning shoe traverse cylinder slidably connected with said positioning shoe foot assembly and comprising a hydraulic piston and rail assembly for receiving and horizontally moving in response to said horizontal force, said positioning shoe traverse cylinder for contacting the oilfield ground moving said drilling rig; and further wherein said positioning shoe cylinder stomper, said positioning shoe traverse cylinder, and said positioning shoe traverse cylinder associate for variable position control of said independently controllable positioning shoe.

2. The drilling rig mobility system of claim 1, further comprising control circuitry and processor capability for precisely and controllable positioning the drilling rig over a target wellbore.

3. The drilling rig mobility system of claim 1, further comprising control circuitry, slewing gear variation, and onboard hydraulic control componentry for providing variable rotational positioning of said positioning shoe foot assembly.

4. The drilling rig mobility system of claim 1, further comprising control circuitry, hydraulic control componentry and processor instructions for operating said positioning shoe selectably in a slaved mode for all positioning shoes to operate in unison or an individual mode for each positioning shoe to operate separately.

5. The drilling rig mobility system of claim 1, further comprising control circuitry, hydraulic control componentry and processor instructions for operating said positioning shoe for positioning the drilling rig across a varying oilfield landscape and terrain.

6. The drilling rig mobility system of claim 1, further comprising control circuitry, hydraulic control componentry and processor instructions for generating precise feedback signals for reporting the proper operation of each of said positioning shoes.

7. The drilling rig mobility system of claim 1, further comprising a hydraulic fluid warming circuit for warming hydraulic fluid within said hydraulic actuator to improve control of said hydraulic actuator when operating said positioning shoe in a cold oil field.

8. A drilling rig mobility method for moving a drilling rig in an oilfield, comprising:

attaching a plurality of independently controllable positioning shoes to the drilling rig and through separate and coordinated position control commands to each of said plurality of independently controllable positioning shoes repositioning the drilling rig, said attaching step further comprising, for each of said independently controllable positioning shoes, the steps of:

containing a hydraulic actuator and wireless control using a housing attached to the drilling rig and providing structural enclosure, providing vertical, horizontal and rotational force in response to wireless control signals from said wireless control circuitry using said hydraulic actuator for;

communicating wireless position and control data and instructions with a remote wireless communications device using said wireless control circuitry for and converting said wireless position and control data and instructions to hydraulic actuator control signals;

vertically elevating said hydraulic actuator using a positioning shoe cylinder stomper for receiving and transferring said vertical and rotational force from said hydraulic actuator;

rigidly connecting a positioning shoe foot assembly to said positioning shoe cylinder stomper, and receiving and transferring said horizontal force from said hydraulic actuator;

slidably connecting a positioning shoe traverse cylinder with said positioning shoe foot assembly and receiving and horizontally moving a hydraulic piston and rail assembly in response to said horizontal movement force, said positioning shoe traverse cylinder for contacting the oilfield ground moving said drilling rig; and further associating said positioning shoe cylinder stomper, said positioning shoe traverse cylinder, and said positioning shoe traverse cylinder for providing variable position control of said independently controllable positioning shoe.

9. The drilling rig mobility method of claim 8, further comprising the step of precisely and controllably positioning the drilling rig over a target wellbore using control circuitry and processor capability associated with said positioning shoe.

10. The drilling rig mobility method of claim 8, further comprising the step of providing variable rotational positioning of said positioning shoe foot assembly using control circuitry and processor capability associated with said positioning shoe.

11. The drilling rig mobility method of claim 8, further comprising the step of operating said positioning shoe selectably in a slaved mode for all positioning shoes to operate in unison or an individual mode for each positioning shoe to operate separately using control circuitry and processor capability associated with said positioning shoe.

12. The drilling rig mobility method of claim 8, further comprising control circuitry, hydraulic control componentry and processor instructions for operating said positioning shoe for positioning the drilling rig across a varying oilfield landscape and terrain using control circuitry and processor capability associated with said positioning shoe.

13. The drilling rig mobility method of claim 8, further comprising the step of generating precise feedback signals for reporting the proper operation of each of said positioning shoes using control circuitry and processor capability associated with said positioning shoe.

14. The drilling rig mobility method of claim 8, further comprising warming hydraulic fluid within said hydraulic actuator to improve control of said hydraulic actuator when operating said positioning shoe in a cold oil field using a hydraulic fluid warming circuit.

15. A drilling rig for use in an oilfield or energy production field and capable of being repositioned in the field using a plurality of wireless command and control signals, said drilling rig comprising:

a superstructure for supporting drilling equipment and directing said drilling equipment into a wellbore;

a base for supporting said superstructure and providing further structural foundation to the drilling rig;

an operator shack for providing an operating space for drilling operators to occupy during drilling operations;

a plurality of base support structures for supporting said base and further providing structure on which to attach a drilling rig mobility system for moving a drilling rig in an oilfield, said drilling rig mobility system comprising:

a plurality of independently controllable positioning shoes for attaching to the drilling rig and through separate and coordinated position control commands to each of said plurality of independently controllable positioning shoes repositioning the drilling rig, each of said independently controllable positioning shoes further comprising:

a housing attached to the drilling rig and providing structural enclosure for containing a hydraulic actuator and wireless control circuitry, said hydraulic actuator for providing vertical, horizontal and rotational force in response to wireless control signals from said wireless control circuitry;

said wireless control circuitry for communicating wireless position and control data and instructions with a remote wireless communications device and converting said wireless position and control data and instructions to hydraulic actuator control signals;

a positioning shoe cylinder stomper for vertically elevating said hydraulic actuator and for receiving and transferring said vertical and rotational force from said hydraulic actuator;

a positioning shoe foot assembly rigidly connected to said positioning shoe cylinder stomper and associated to receive and transfer said horizontal force from said hydraulic actuator;

a positioning shoe traverse cylinder slidably connected with said positioning shoe foot assembly and comprising a hydraulic piston and rail assembly for receiving and horizontally moving in response to said horizontal movement force, said positioning shoe traverse cylinder for contacting the oilfield ground moving said drilling rig; and further wherein said positioning shoe cylinder stomper, said positioning shoe traverse cylinder, and said positioning shoe traverse cylinder associate for variable position control of said independently controllable positioning shoe.

16. The drilling rig of claim 15, wherein said drilling rig mobility system further comprises control circuitry and processor capability for precisely and controllable positioning the drilling rig over a target wellbore.

17. The drilling rig of claim 15, wherein said drilling rig mobility system further comprises control circuitry, slewing gear variation, and onboard hydraulic control componentry for providing variable rotational positioning of said positioning shoe foot assembly.

18. The drilling rig of claim 15, wherein said drilling rig mobility system further comprises control circuitry, hydraulic control componentry and processor instructions for operating said positioning shoe selectably in a slaved mode for all positioning shoes to operate in unison or an individual mode for each positioning shoe to operate separately.

19. The drilling rig of claim 15, wherein said drilling rig mobility system further comprises control circuitry, hydraulic control componentry and processor instructions for operating said positioning shoe for positioning the drilling rig across a varying oilfield landscape and terrain.

20. The drilling rig of claim 15, wherein said drilling rig mobility system further comprises control circuitry, hydraulic control componentry and processor instructions for generating precise feedback signals for reporting the proper operation of each of said positioning shoes.

* * * * *